United States Patent [19]

Polderman

[11] 4,291,733

[45] Sep. 29, 1981

[54] DEVICE FOR HANDLING CONTAINERS

[75] Inventor: Pieter A. Polderman, Ah Heemstede, Netherlands

[73] Assignee: Stork Repak B.V., Utrecht, Netherlands

[21] Appl. No.: 47,321

[22] Filed: Jun. 11, 1979

[30] Foreign Application Priority Data

Jun. 9, 1978 [NL] Netherlands ..... 7806303
Nov. 10, 1978 [NL] Netherlands ..... 7811174

[51] Int. Cl.[3] ..... B65B 43/42
[52] U.S. Cl. ..... 141/152; 141/177
[58] Field of Search ..... 141/135, 163, 168, 177, 141/138–152; 198/339

[56] References Cited

U.S. PATENT DOCUMENTS 3,825,043 7/1974 Fechheimer ..... 141/152 X
3,889,726 6/1975 Stigler ..... 141/142

*Primary Examiner*—Frederick R. Schmidt
*Attorney, Agent, or Firm*—Barry G. Magidoff

[57] ABSTRACT

A device for handling containers, more particularly a machine for filling bottles. This device comprises a common polygonal path for the bottle conveyor and for a plurality of movable active members travelling above said polygonal path, the said members being coupled to an endless drawing member travelling through a path lying parallel to and above the said polygonal path.

14 Claims, 11 Drawing Figures

-14,15-
13
43
VII c
VII c
25
18
17
45'
12
27

DEVICE FOR HANDLING CONTAINERS

BACKGROUND OF THE INVENTION

The invention relates to a device for handling containers being supplied in a continuous row, more particularly a machine for filling bottles, comprising a driven horizontal conveyor for containers, the said containers travelling in a path of operation having the shape of an almost closed loop, further comprising a plurality of movable active members above the loop-shaped path of operation, the said members being connected to a common provision and having a drive coupled to the conveyor drive, an arranging element being present near the inlet of the path of operation for an equidistant interspacing of the supplied containers. Such a device is for instance known as a bottle filling machine, although the same structure could be used for testing containers under pressure, for scanning the level of the filling liquid in bottles, for cleaning, labelling and/or closing (sealing off) the bottles.

SUMMARY OF THE INVENTION

A first object of the invention consists in proposing a novel manner of co-operation between the active members and the containers. The invention further aims to provide a structural simplification in the way in which the containers are fed into, passed through and discharged from said device. These aims are obtained in that the active members are coupled to an endless drawing member travelling through a path lying parallel to and above the operative path of the containers, and in that the conveyor also follows the operative path of the containers, said path having a polygonal shape around the common provision.

These features render it possible to adapt the device to different sizes or forms of the containers and to enlarge or decrease the capacity of the device without causing problems about the synchronisation of the velocity of different elements involved in the handling of the containers.

Another object of the invention consists in reducing the overall height of the device in comparison with earlier proposals. This aim is realized in that the coupling between the drives of the active members on the one hand and of the conveyor on the other hand is effected by a form proof connection located outside the loop-shaped operative path. Owing to these measures the flexible connecting conducts between the common provision and the active members, may be located within the region of the loop-shaped path without any interference occurring whilst moveover the common provision, that is to say the central liquid vessel, may be located less elevated, which will lead to a considerably lower static liquid column in a filling machine.

SURVEY OF THE DRAWINGS

The improvement as described hereinbefore and further characteristic features of the present invention will now be described by means of the accompanying drawing, diagrammatically showing some details and variants of the device in accordance with the invention.

Figure 1:
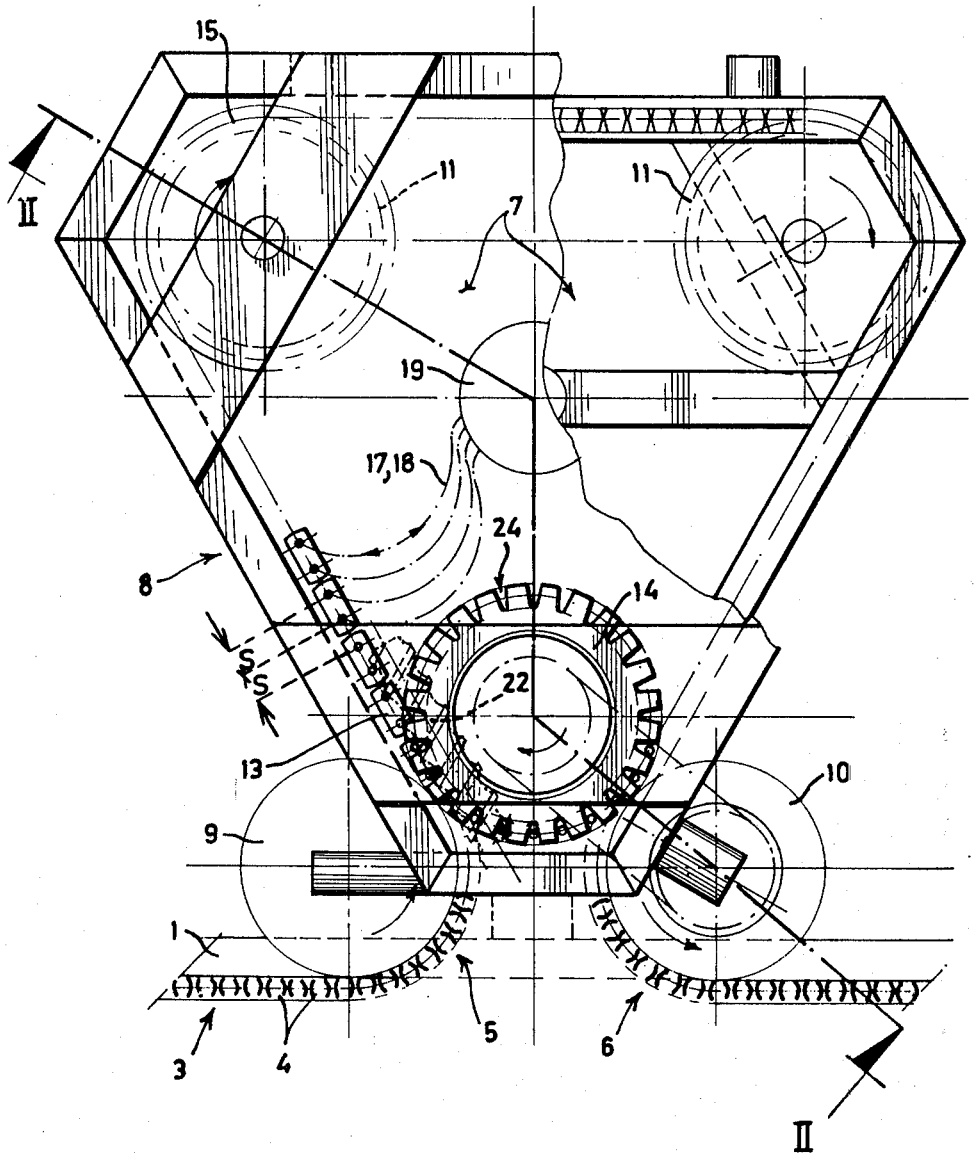
FIG. 1 shows a top view of a machine having a substantial triangular path of operation.
Figure 3:
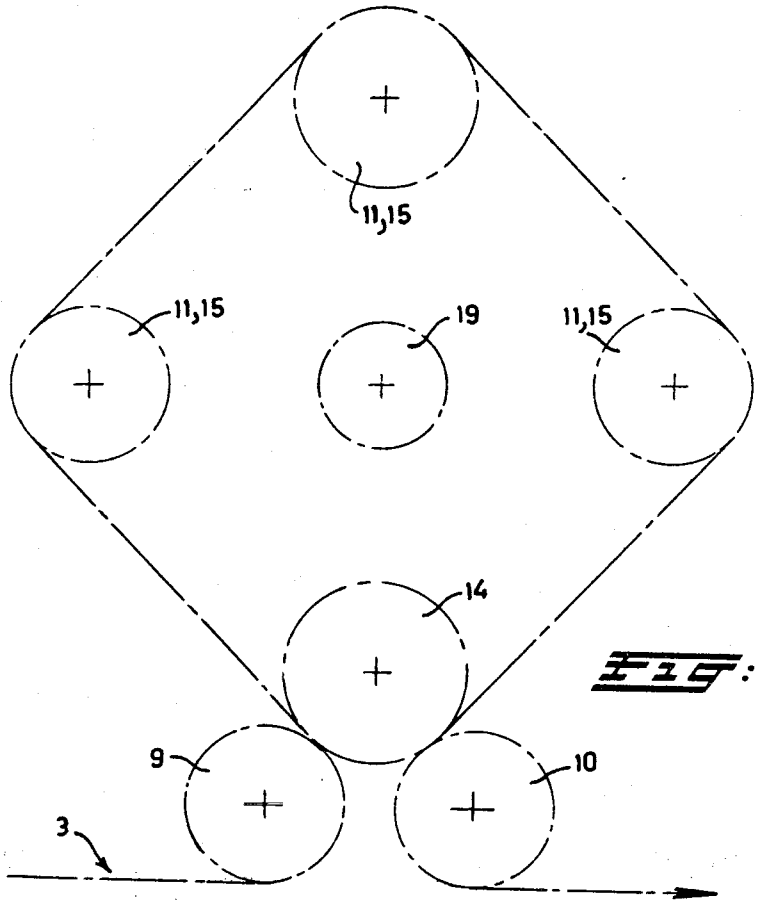
Figure 4:
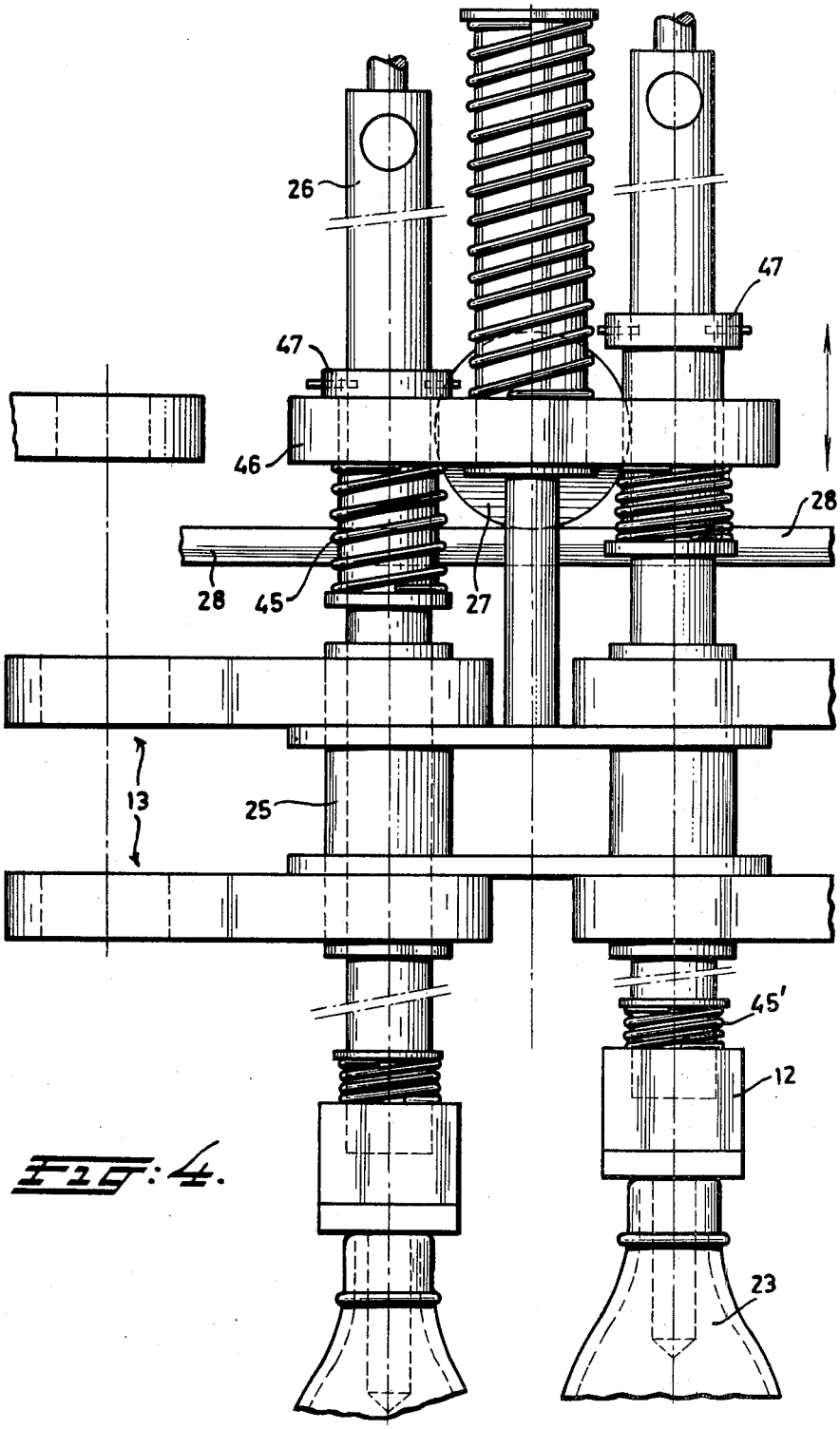
Figure 5:
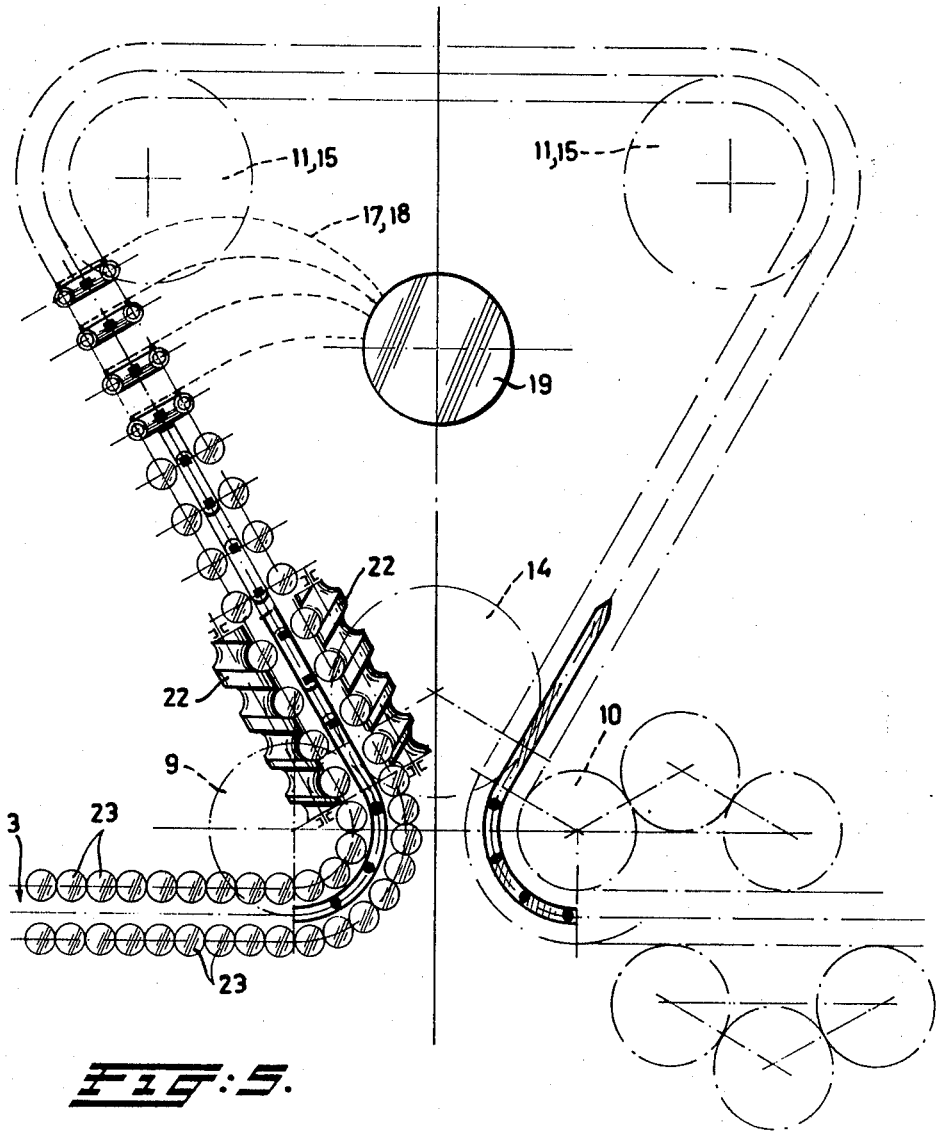
Figures 6A, 6B, 6C:
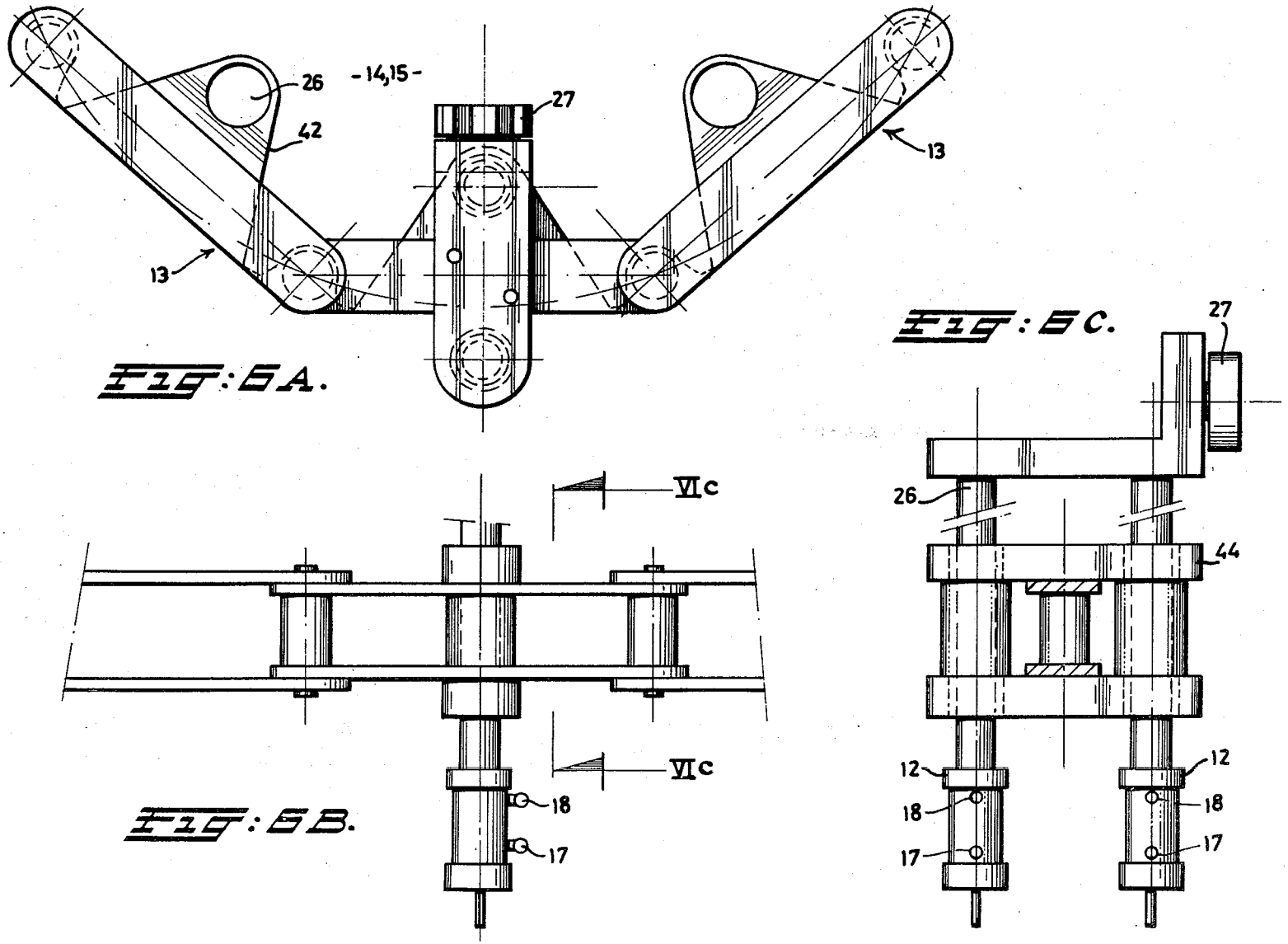
Figures 7A, 7B, 7C:
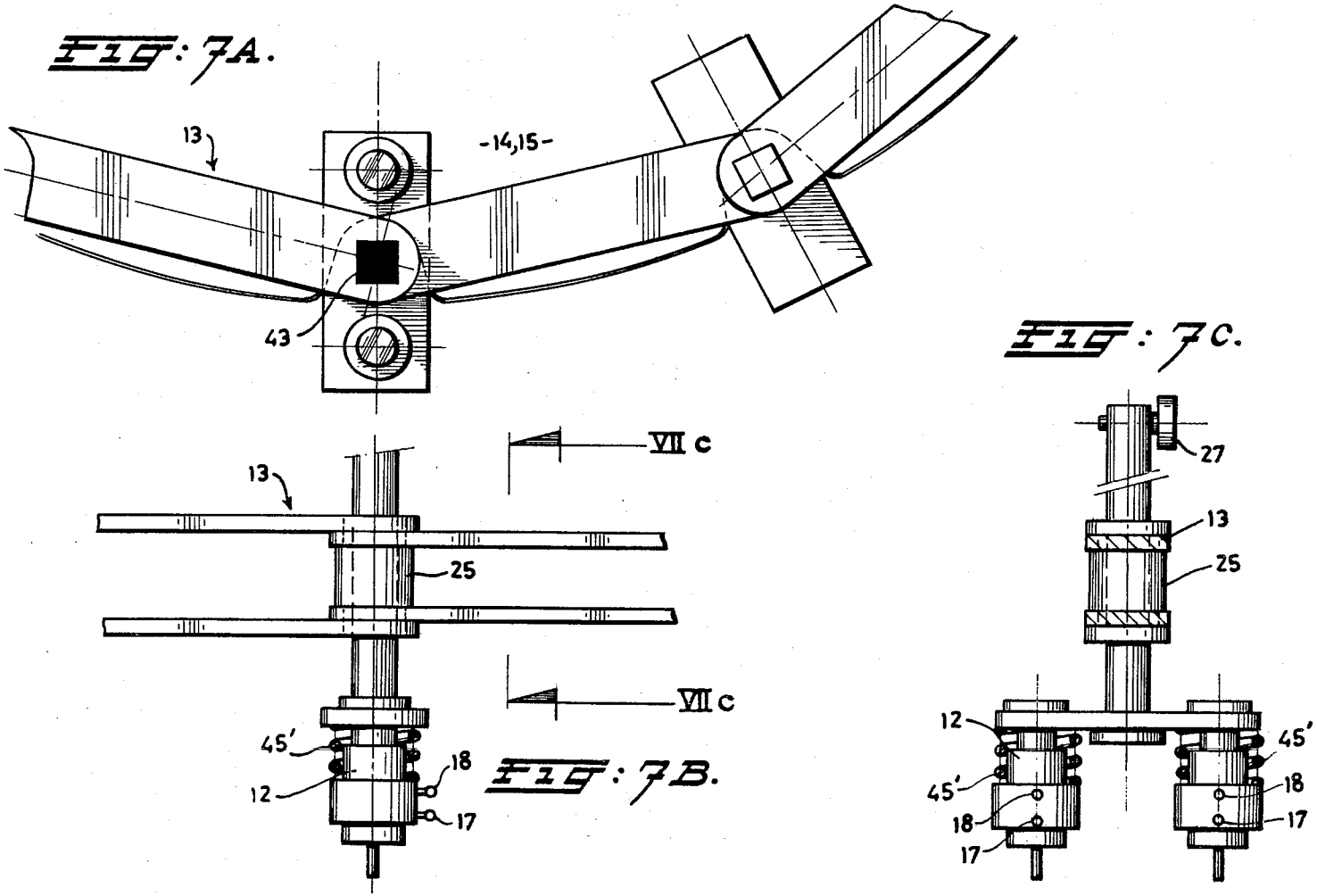

FIG. 3 very diagrammatically shows a loop-shaped path having an almost square shape;

FIG. 4 shows a detail of a device in accordance with the invention being in this case a machine for filling bottles comprising two active members (filling valves) simultaneously engaging two containers;

FIG. 5 shows the device of FIG. 1 wherein a double row of containers can simultaneously be processed in the device according to the invention;

FIGS. 6A–C and 7A–C show two variants of the manner in which the active members (the filling valves) can be arranged in an endless drawing member in order to be applied in the device as shown in FIG. 5.

DESCRIPTION OF A PREFERRED EMBODIMENT

The device in accordance with the invention consists of a frame 1 having legs 2 upon which a conveyor 3 is accommodated, built up in the usual manner from links 4 capable of pivoting in the plane of the conveyor proper. The conveyor 3 comprises an inlet 5 and an outlet 6 in between which the conveyor travels through a path of operation 7, having the shape of an almost closed loop.

In the embodiment as shown in FIGS. 1 and 5 the said operative path 7 is triangular and consists of three straight parts 8. The shape of the triangle is defined by a guide wheel 9 at the inlet of the operative path and a guide wheel 10 at the outlet of the said path, whereby at least two guide wheels 11 are present at the base of said triangle.

Figure 2:
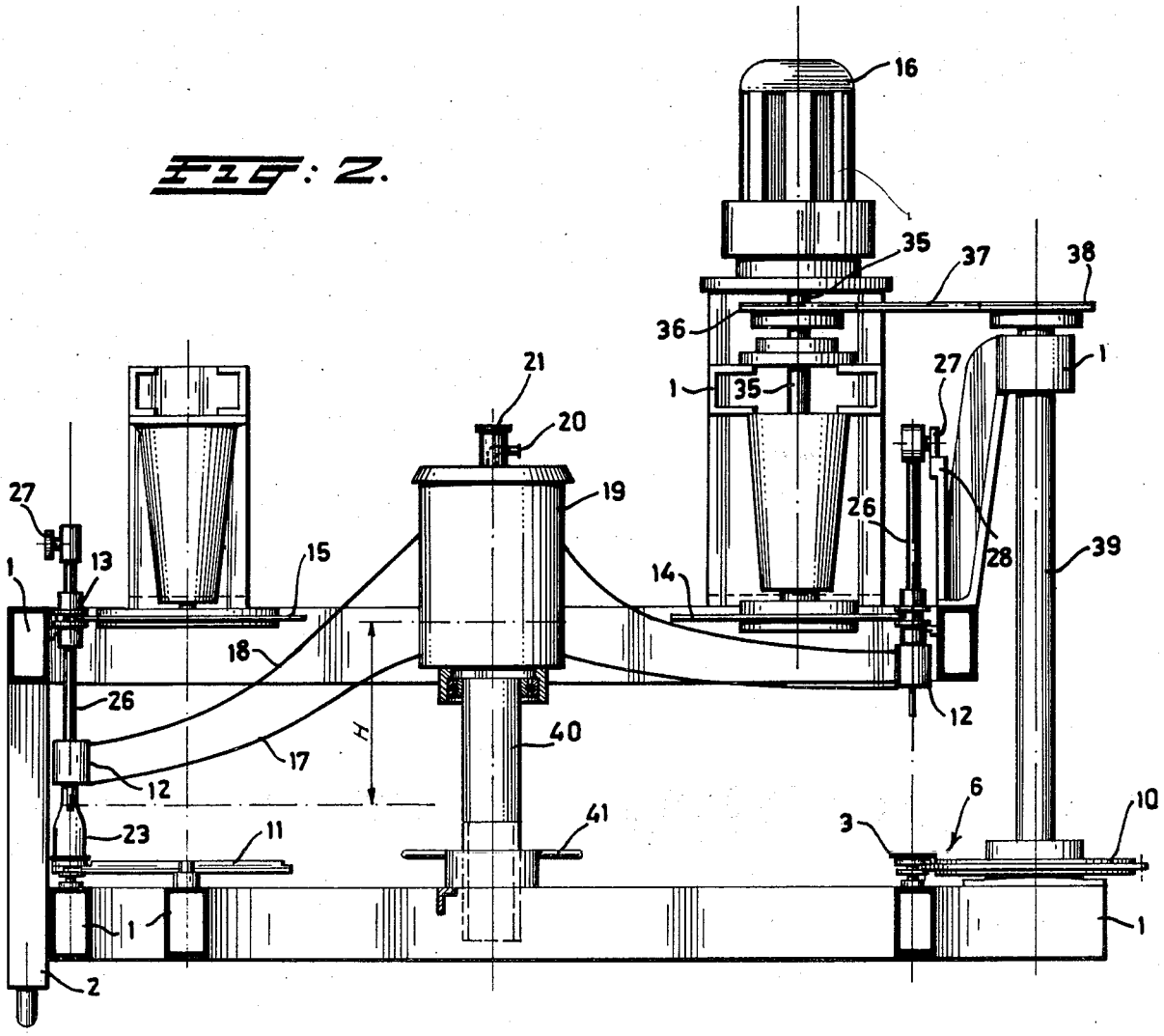
FIG. 2 is a section across the line II—II in FIG. 1 showing the manner of driving the various parts of the device in accordance with the invention.

As can be seen in FIG. 2 a plurality of filling valves 12 are movably accommodated within an endless drawing member 13 above the loop-shaped operative path 7. The drawing member 13 consists of a chain which is guided along a driven wheel 14 above the inlet 5 and outlet 6 at the path 7. The chain 13 is further guided along two wheels 15 (see FIG. 1) being located co-axially above the guide wheels 11. The drive is carried out by means of a motor 16 which is coupled to a wheel 14 and to the conveyor 3 in a manner to be described hereinafter.

Each filling valve 12 is connected to a common provision 19 by means of flexible hoses 17 and 18, the common provision 19 in this case consisting of a central product supply. The hoses 17 serve for the supply of filling liquid and the hoses 18 serve for the transfer of gas. Since the filling valves 12 with the chain 13 travel in a closed path, the central product supply 19 is carried out as a slowly revolving vessel. At the upper side of the vessel 19 there is a connection 20 for vacuum, if any. The filling liquid is supplied through a connection 21. In the vicinity of the inlet 5 of the operative path 7 there is an arranging member 22 in the form of a rotatable positioning worm, likewise being connected with the central driving motor 16. This arranging element serves for equidistantly interspacing the supplied containers 23 adjoining one another at the inlet 5 of the conveyor 3. The containers 23 have to be positioned and placed at a certain pitch and brought into phase prior to filling the containers 23, so as to be capable of a co-operation with the filling valves 12. The said pitch S is defined by and corresponds to the pitch of the worm 22. The same length of pitch is present in between the filling valves 12 and the recesses 24 of the driven wheel 14.

As can be seen in FIGS. 2 and 4, the endless drawing member 13 is formed by a chain with pivot pins 25 which co-operate with recesses 24 of the driven wheel 14 whilst they further serve for an upward and downward movement of the filling valves 12. For that purpose the upper side of each filling valve is provided with a tube or rod 26 supporting a roller 27 which cooperates with a cam path 28. As can be seen in FIG. 4, two rods 26 and subsequently two filling valves 12 can be simultaneously controlled by one single roller 27.

FIG. 2 shows that the single motor 16 can drive the entire installation, for which purpose the said motor is, coupled directly through a shaft 35 to the wheel 14 and to an intermediate wheel 36 which is coupled to a chain wheel 38 through a chain 37. This wheel 38 is situated co-axially above the guide wheel 10 and is connected therewith by a vertical shaft 39 having an upper and a lower bearing within the frame 1. From this it follows that the drawing member 13 is driven directly through the motor 16 via wheel 14, whilst the conveyor is driven by the guide wheel 10 through the branch 36–39. The elements 35–39 constitute a form-proof connection situated outside the loop-shaped operative path 7 between the two drives 14 and 10.

The product vessel 19 is mounted rotatably upon a central support 40 having a threaded hand wheel 41 by means of which the height of the product vessel can be adjusted within the operative path 7 for adaptation to the length of containers 23 to be handled, in dependence of the level of the filling valves 12.

FIGS. 4, 6 and 7 show that the active members or filling valves 12 are always mounted pairwise, whereby in the embodiment of FIG. 4 the centres of the valves coincide with the pivot pins of the endless drawing member 13.

In the embodiment of FIGS. 6 and 7 the filling valves are always mounted at either side of the drawing member 13. In FIG. 6 the configuration is transverse to the centre of each chain link, so that the shape of the guide wheels 14 and 15 is adapted correspondingly, see the recess 42.

In the embodiment of FIG. 7 the pairwise filling valves 12 are mounted at the location of the pivot pins 43 of the drawing member 13.

In the embodiment of FIGS. 4 and 7 the pivot points of the drawing member 13 form a guide for an upward and downward displacement of the filling valves 12. In the embodiment of FIG. 6 each chain comprises a yoke 44 constituting the guide for the valves 12.

As can be seen clearest in FIG. 4, the connection between the cam path 28, the roller 27 respectively on the one hand, and the filling valves 12 on the other hand comprises at least a resilient link 45 for compensating any differences in size of the containers 23. The roller 27 is coupled to a sliding piece 46 which is pressed against an abutment 47 upon tube 26 by means of the resilient link 45. There may be a resilient link 45′ between each tube or rod 26 and the filling valve 12. The embodiment of FIG. 7 only includes the latter mentioned resilient link 45′.

In the embodiment of FIG. 4 the hoses 17 and 18 may be connected with the filling valves 12 through the rod or tube 26.

In the embodiment of FIG. 2 the said hoses 17 and 18 are connected directly with the filling valves mounted upon the lower part of the rods 26 which may be rods having a cam roller 27 at their upper side. A filling valve of the type as described in British Pat. No. 1,346,667 may be used.

With respect to the embodiment of FIG. 3 it should be noted that an almost square loop shape of the operative path 7 is exhibited, in that the conveyor 3 is guided along wheels 9 and 10 and along three guide wheels 11. The endless drawing member 13 travels a similar path being defined by the driven wheel 14 and three guide wheels 15.

The advantage of the latter embodiment is in that any changes in length of the hoses 17 and 18, are less than in the triangular embodiment of FIG. 1. The construction may further be built up from square components which is less costly.

The advantages of the present invention appear clearest in FIG. 3 which shows a machine for filling bottles, capable of operating under a normal atmospheric pressure or with a certain vacuum. In a similar machine the filling valves have to be displaceable over a considerable height for bridging the differences in length of bottles to be handled. This appears from a comparison between the left and right-hand side of FIG. 2. In the embodiment suggested in connection with FIG. 2 the hoses between the central product vessel and the filling valves had to be connected to the upper end of the tubular rod 26 in order to allow for an uninterrupted rotational movement of the said hoses during operation of the machine. This resulted in a filling valve having a considerable length and causing the following problems: When small bottles or containers are used the velocity of filling is too high, with respect to the length of the static water column. When dealing with foaming products the filling capacity may be influenced disadvantageously. The longer channels in a high valve, involve a labour consuming and so, expensive, cleaning of said valves. When vacuum valves are used the vacuum in the product vessel will have to exceed the length of the static water column. It is known that this vacuum prevents a damaged bottle to be filled whilst it also provides for leakage-free valves. The high vacuum to be exerted has disadvantageous effects upon some products due to a possible loss of the alcoholic rate or of the aromatic properties.

Due to the coupling between the drives of the filling valves and the conveyor being located outside the loop-shaped path of operation, the connecting hoses of the product vessel may be directly secured to the lowermost part of the filling valves. This renders it possible to mount the product vessel proper on a lower level in the device, so that the static liquid column will get considerably shorter. The displaceable mounting of the product vessel further enables an adaptation to lower or higher containers. Furthermore it will now become possible to drive the drawing member (the chain) of the filling valves directly and to drive the conveyor for bottles through a branch at a location which will stay unchanged when the operative path is enlarged or decreased. Such a location is for example the discharge wheel 10.

A further important advantage of the present invention is shown in FIGS. 6 and 7 in which it is illustrated that the filling valves 12 may be mounted pairwise, transverse to the drawing member 13. This pairwise mounting enables a certain processing capacity to be obtained with a velocity of travel of the conveyor 3 and of the drawing member 13, being half the required velocity of a machine according to the conventional devices. Though in this case two arranging elements 22 are required (see FIG. 5), there are some notable advantages:

the length of the drawing member 13 is halved and subsequently the dimension of the operative path 7, when an equal number of filling valves is used;

the reduced velocity of travel of the conveyor 3 and of the drawing member 13 will likewise reduce any wear occurring and the produced noise, thus causing the device in accordance with the invention to remain within the norms stipulated with respect to noise hindrance.

I claim:

1. A device for handling and filling containers comprising (a) a conveyor for containers, a portion of the path of said conveyor having the shape of an almost closed loop;

(b) a common provision;

(c) a plurality of active members movably mounted above the almost closed loop conveyor path and being connected to the common provision;

(d) drive means for the conveyor and for moving the active members;

wherein the improvement comprises:

(e) an endless drawing member mounted above and traveling in a path lying parallel to the almost closed loop conveyor path, the endless drawing member being directly connected to each of the active members;

(f) a shaft extending from the drive means, the drive means being mounted above the conveyor path;

(g) means for connecting the shaft to the endless drawing member; and (h) means for connecting the shaft to the conveyor, such that the endless drawing member and the conveyor are driven by the shaft;

the almost closed loop portion of the conveyor path having a polygonal shape.

2. The device of claim 1 comprising in addition an inlet guide and drive member and an outlet guide and drive member for the conveyor, the two drive members being located in close proximity at the portion of the almost closed loop path of the conveyor, an arranging member being provided adjacent the inlet guide member.

3. The device of claim 2 wherein the conveyor comprises at least two guide members in addition to the inlet and outlet guide members and further comprising means for adding additional guide members to increase the total path length of the almost closed loop portion of the conveyor.

4. A device for filling bottles comprising a driven horizontal conveyor for supporting bottles, the conveyor traveling in a path having the shape of an almost closed loop; a plurality of vertically reciprocating rods; filling valves mounted on a lower portion of the rods; an endless drawing member located above the conveyor and movable in a path above and parallel to the path of the conveyor; the rods and the valves being connected to and movable with the endless drawing member, the path of the conveyor and of the vertical rods being polygonal; drive means operatively connected to drive the conveyor and to drive the endless drawing member and the vertical rods synchronously about the horizontal path; inlet and outlet guide members and at least two other guide members connected to the conveyor, one of the guide members being a drive member operatively connected to the drive means and the inlet and outlet guide members being in close proximity; and means for adding additional guide members to increase the total path length of the almost closed polygonal loop portion of the conveyor and of the endless drawing member.

5. A device for handling containers of the type comprising:

(a) a conveyor for containers, a portion of the path of said conveyor having the shape of an almost closed loop;

(b) a common provision;

(c) a plurality of movable active members above said portion of the conveyor path, said active members being connected to the common provision;

(d) an inlet guide wheel and an outlet guide wheel for the conveyor;

(e) an arranging member near the inlet guide wheel designed to equidistantly space any containers supported on the conveyor;

wherein the improvement comprises:

(f) a drive means mounted above the conveyor;

(g) a shaft extending from the drive means;

(h) an endless drawing member traveling in a path lying parallel to and above said portion of the conveyor path, the active members being directly connected to the endless drawing member;

(i) first connector means for connecting the shaft to the endless drawing member;

(j) second connector means for connecting the shaft to the conveyor, so that the endless drawing member and the conveyor are driven by the shaft; and (k) said portion of the conveyor path forming an almost closed loop having a polygonal shape.

6. A device according to claim 5, in which the arranging member is provided in a straight portion of the polygonal operative path, while the active members on the drawing member are mutually spaced in conformity with the spacing provided by the arranging member.

7. The device of claim 5, wherein the active members are coupled pairwise and are lying at either side of the drawing member.

8. The device as defined in claim 7, wherein the drive means comprises a motor located above the endless drawing member, the first connector means comprising a guide wheel for the endless drawing member, the second connector means comprising a second vertical shaft, and a non-resilient driving connector between the second shaft and the first shaft, and wherein the second shaft is directly connected to the outlet guide wheel.

9. A device according to claim 5, wherein the second connector means is located outside of the almost closed loop, and is a non-resilient mechanical connection.

10. The device of claim 9, comprising a vertically adjustable central support for the common provision, the common provision being rotatably mounted upon the central support, such that the height of the common provision above the operative path is adjustable by means of the central support for adaptation to the length of the containers to be handled independent of the level of the active members.

11. The device as defined in claim 5, comprising in addition at least two guiding wheels, and wherein the almost closed loop has the shape of a triangle, the two guiding wheels defining the base of the triangle.

12. The device of claim 5, wherein the first connector means includes a driven guide wheel comprising recesses corresponding to the spacing provided by the arranging member, wherein the endless drawing member is guided above the inlet and outlet of the conveyor by the driven guide wheel.

13. The device of claim 5, wherein the active members are reciprocating filling valves and wherein the endless drawing member comprises a link chain including pivot pins between the links, each link having a length corresponding to the spacing provided by the arranging member for one half of the spacing, and wherein the pivot pins comprise a sleeve for guiding the reciprocal movement of the filling valves.

14. The device as defined in claim 13, wherein two or more adjacent filling valves are intercoupled and further comprising a common control roller for operating the adjacent filling valves.

* * * * *